US005266967A

United States Patent [19]

Maslanka et al.

[11] Patent Number: 5,266,967

[45] Date of Patent: Nov. 30, 1993

[54] EDGE READING DONOR SENSORS FOR A THERMAL PRINTER

[75] Inventors: Daniel C. Maslanka, Rochester; Robert E. Moore, Hilton, both of N.Y.

[73] Assignee: Eastman Kodak Company, Rochester, N.Y.

[21] Appl. No.: 928,671

[22] Filed: Aug. 12, 1992

Related U.S. Application Data

[63] Continuation of Ser. No. 750,358, Aug. 27, 1991, abandoned.

[51] Int. Cl.[5] ..... B41J 35/22

[52] U.S. Cl. ..... 346/76 PH; 400/711

[58] Field of Search ..... 346/76 PH; 400/120 MP, 400/703, 237 E, 711, 240.3

[56] References Cited

U.S. PATENT DOCUMENTS 4,551,729 11/1985 Kubo et al. ..... 346/1.1

4,620,199 10/1986 Tatsumi et al. ..... 346/76 PH 4,710,781 12/1987 Stephenson ..... 346/76 PH

FOREIGN PATENT DOCUMENTS 0039590 3/1984 Japan ..... 400/120 MP 0104961 6/1984 Japan ..... 400/120 MP 0172673 7/1988 Japan ..... 400/237 E

*Primary Examiner*—Benjamin R. Fuller

*Assistant Examiner*—N. Le

*Attorney, Agent, or Firm*—Milton S. Sales

[57] ABSTRACT

A thermal printer is provided with edge reading donor sensors that detect the presence of different color patches on the donor as the donor advances. The sensors detect the intrusion of a new color patch during the print cycle to stop the donor advance and properly position the donor relative to the receiver. The sensors are positioned alongside the thermal head and as near to the end of the print drum as possible. The sensors are thereby positioned as close to the heater line of the thermal head as possible preventing waste of donor.

3 Claims, 1 Drawing Sheet

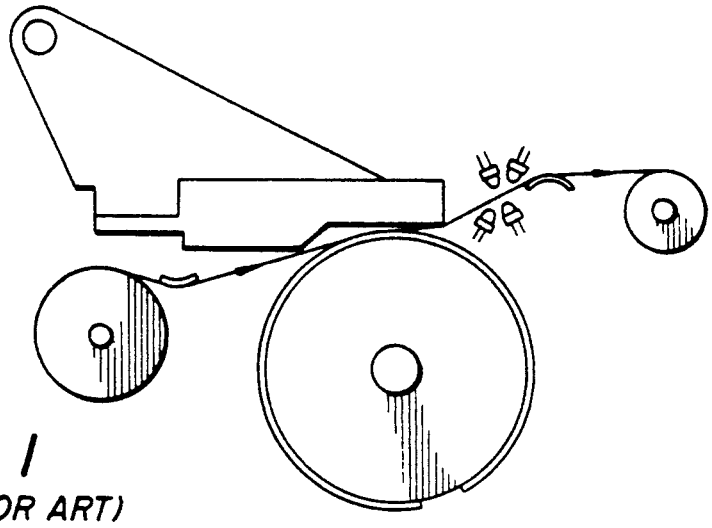
FIG. 1
(PRIOR ART)
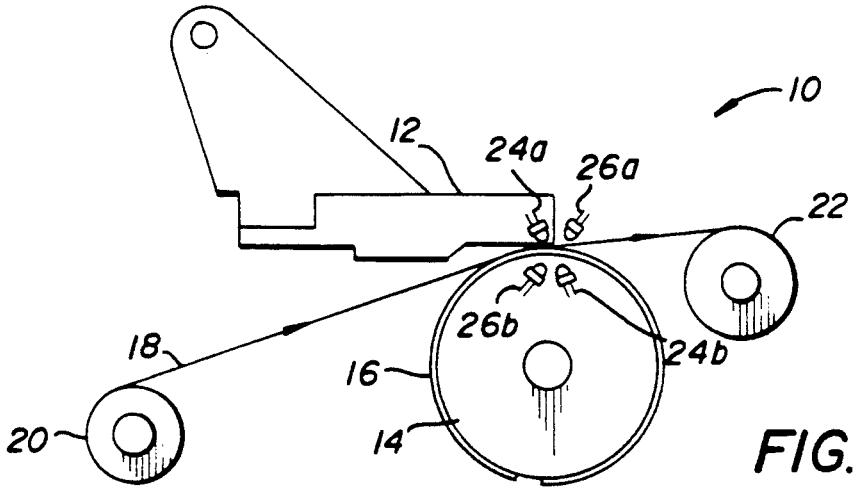
FIG. 2
FIG. 3
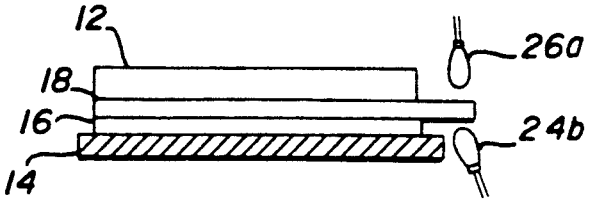

EDGE READING DONOR SENSORS FOR A THERMAL PRINTER

This is a continuation of U.S. patent application Ser. No. 750,358, filed Aug. 27, 1991abandoned.

FIELD OF THE INVENTION

This invention relates generally to color thermal printers and, more particularly, relates to sensors which sense the color and position of the dye donor patches of the thermal dye transfer ribbon in the printer.

BACKGROUND OF THE INVENTION

To print effectively and efficiently using a color thermal printing process, the dye impregnated color donor web must be properly positioned relative to the dye receiver. Proper positioning is required to ensure full coverage of the image area by successive color patches. The typical color donor web contains a repeating series of yellow, magenta and cyan color patches, and in some cases, a black patch and/or a clear fusing patch. Each patch must be properly aligned with the receiver to ensure high quality printing. One way to align or index the receiver and donor is by using a detector which will detect whether the color is yellow, magenta, cyan, black or clear, and identify its position.

One type of sensing system is disclosed in U.S. Pat. No. 4,551,729 which issued Nov. 5, 1985 to Takeshi Kubo, Junji Kawano, Fumio Takahashi and Tsutomu Yamaguchi, wherein a donor web is encoded with marks that are detected by a detecting means after the donor passes the thermal print head. This system, however, is used with paper in the fanfold design with pre-punched or pre-drilled edges. The drum has a large diameter so that the indexing of the donor web with the paper is not absolutely critical but there must be general alignment. The general alignment is obtained with the sensor elements placed in the donor path past the thermal print head so that the marks are detected after the donor emerges from the print head. One of the difficulties with this system is that the pre-punched holes, which the protrusions on the drum engage to advance the donor and the receiver, are prone to stretching and misalignment, thereby degrading the print quality.

A thermal printer with a different sensing arrangement is disclosed in U.S. Pat. No. 4,620,199 which issued Oct. 28, 1986 to Hisao Tatsumi, Haruhiko Kayata and Fumio Watanabe. The donor web is in a cassette with an opening therein for engagement with a sensor. The donor passes by the sensor at one point which is relatively far from the area where printing occurs. The color sensor senses the color of the donor as the donor is unwound from the donor supply spool before printing occurs. Understandably, much could happen between the location of the sensor and the printing location while the donor ribbon traverses this course. Accordingly, it will be appreciated that it would be highly desirable to have a color sensor to accurately sense the position and color of the donor ribbon for accurate registration of the colors during printing.

U.S. Pat. No. 4,710,781 which issued Dec. 1, 1987 to Stanley W. Stephenson discloses an apparatus for identifying different color frames of a donor web. A sensor includes a light emitting diode (LED) to emit red or yellow light and a corresponding photodetector to respond to the red or yellow light. A space saving arrangement positions two LEDs to illuminate the same spot on the donor web adjacent an edge of the web. The yellow and red light pass through dye frames of the moving donor web and illuminate the appropriate photodetectors. The general alignment is obtained with the sensor elements placed in the donor path past the thermal print head so that color frames are detected after the donor emerges from the print head. Where frames are detected after printing, there is an amount of each frame, equal to the length of donor between the print head and detectors, that is wasted. Accordingly, it will be appreciated that it would be highly desirable to have sensors to accurately sense the position and color of the donor web for accurate registration of the colors during printing and to minimize wasted donor.

SUMMARY OF THE INVENTION

The present invention is directed to overcoming one or more of the problems set forth above. Briefly summarized, according to one aspect of the present invention, an edge reading donor sensor is provided for a thermal printer. The thermal printer includes a print head and a drum with a donor web which traverses a path between the print head and the drum to effect thermal printing onto a receiver. The edge reading donor sensors are positioned along the web path at a location after the donor web emerges from the printing area between the drum and the print head. The edge reading donor sensors are located along the donor web path at a location adjacent to the printing area of the print head.

The edge reading donor sensors are located in close proximity to the thermal print head. When the sensors detect the intrusion of a new color patch during the printing cycle, the donor advance is stopped to properly position the donor relative to the receiver. It is desirable to position the sensors as close to the heater line of the thermal head as possible because all donor which occupies the distance after positioning is not used in printing and is therefore wasted. The physical configuration of the printing drum, thermal head and surrounding mechanism often limits the minimum distance that can be achieved; however, the present invention avoids these constraints. The present invention positions the sensors alongside the thermal head and as close to the end of the printing drum as possible. The donor can then be routed so that it overhangs the print drum slightly to pass the sensors.

It is an object of the present invention to accurately sense and properly position the dye carrying donor web relative to the receiver to ensure full coverage of the image area by successive color patches. It is a feature of the invention that this object is achieved by placing color discriminating optical sensors directly in the donor path in the vicinity of the thermal head in the direction of donor travel. When the sensors detect the intrusion of a new color patch during the print cycle, the donor advance is stopped, properly positioning the donor relative to the receiver.

Another object of the present invention is to minimize the waste of donor caused by improper positioning. This object is achieved by placing the sensors as close to the heater line of the thermal head as possible. An advantage of placing the sensors close to the heater line of the thermal head is that the distance unused is practically eliminated because the sensors are at the point of printing.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

FIG. 1 is a simplified diagrammatic side view of a prior art thermal printer illustrating the placement of donor sensors.

FIG. 2 is a diagrammatic side view of a preferred embodiment of a thermal printer incorporating donor sensors positioned in accordance with the present invention.

FIG. 3 is a diagrammatic sectional view taken along line III—III of FIG. 2.

DESCRIPTION OF THE PREFERRED EMBODIMENTS

Referring now to the drawings, in which like numerals indicate like elements throughout the several figures, FIGS. 1 and 2 illustrate a thermal printer 10 which has a thermal print head 12 and a printer platen or drum 14. A dye receiver media sheet 16 is entrained about the drum 14. A dye donor supply web 18 is wound about a donor supply spool 20, and winds its way through the thermal printer 10 to a take up spool 22 where the donor web 18 is wound after use.

The drum 14 is spaced from the print head 12 so that the donor web 18 can pass between the drum 14 and the thermal print head 12. The donor 18 passes between the drum 14 and thermal print head 12 so that dye may be transferred, by sublimation or the like, from the donor web 18 onto the receiver 16 that is wound on the print drum 14. After the donor web 18 passes between the drum 14 and print head 12, the donor web 18 is wound onto the take up spool 22.

The thermal printer 10 also includes two sets of donor sensors 24*a*, 24*b* and 26*a*, 26*b*. The sensors 24 and 26 may be any type of sensor that can detect the color of the donor web 18 and the transition between color frames on the donor web 18. It is preferable however, that the donor sensors 24 and 26 be infrared light sources and detectors. Suitable sensors and detectors are described in U.S. Pat. No. 4,710,781 which is incorporated herein by reference.

More important than the type of sensors and detectors used is the positioning of the sensors. The sensors 24, 26 are to be positioned alongside the head 12 as close to the printing drum 14 as possible. Preferably, the donor 18 can be routed in such a way that it overhangs the drum 14 slightly so that an edge of the donor 18 passes between the two parts of each sensor 24*a*, 24*b* and, 26*a*, 26*b*. A diagonal space saving arrangement is preferred where both LEDs in the sensors focus on the same point on the donor web 18. By this construction, each color patch of the donor web can be detected correctly.

Operation of the present invention is believed to be apparent from the foregoing description and drawings, however, a few words will be added for emphasis. During the color thermal printing process it is necessary to have the dye carrying donor web 18 properly positioned relative to the receiver 16 to ensure full coverage of the image area by successive color patches and a clear fusion patch. The present invention meets this need by placing color discriminating optical sensors 24, 26 directly in the donor path in the direction of travel of the donor 18. The sensors 24, 26 detect the presence of different color patches on the donor 18 as the donor 18 advances. When the sensors 24, 26 detect the intrusion of a new color patch during the print cycle, the donor advance is stopped thereby properly positioning the donor 18 relative to the receiver 16. The sensors 24, 26 are positioned as close to the heater line of the thermal head 12 as possible because all donor which occupies that distance after positioning is not used in printing and is therefore wasted.

It can now be appreciated that there has been presented a sensor arrangement for a thermal printer that properly positions the donor relative to the receiver for quality printing. The thermal printer includes a thermal printing head having a plurality of heating elements forming a thermal line. A printing drum is mounted near the printing head and spaced from the thermal line, and a receiver is mounted on the printing drum. A dye carrying donor web traverses a path between the print head and drum for printing contact with the receiver. Color discriminating optical sensors are positioned directly in the donor path near the thermal heater line to detect different color patches on the donor web as it advances.

While the invention has been described with particular reference to a preferred embodiment, it will be understood by those skilled in the art that various changes may be made and equivalents may be substituted for elements of the preferred embodiment without departing from the invention. For example, while the sensors have been shown and described as arranged in diagonal pairs, arrangements other than diagonal may be used as long as they detect the different color patches accurately. In addition, many modifications may be made to adapt a particular situation and a material to a teaching of the invention without departing from the central teachings of the present invention.

It can now also be appreciated that there has been presented a sensor arrangement for a thermal printer that properly positions the donor relative to the receiver for improved color registration and full coverage of the image area by successive color patches, and a clear fusing patch if desired. This is accomplished by positioning the sensors alongside the thermal head and as near to the end of the printing drum as possible and, routing the donor to overhang the printing drum slightly to pass between the sensors.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A thermal printer for printing from a dye donor web onto a dye receiver, comprising:

a thermal printing head having a plurality of heating elements forming a thermal print line;

a printing drum mounted near said printing head and spaced from said thermal print line a preselected distance, said printing head and said printing drum defining a path for said dye donor web; and color discriminating optical sensors positioned alongside said thermal printing head near one end of said printing drum and directly in said donor web path at said thermal print line of said printing head to thereby detect different color patches on said donor web as said donor web advances, said dye donor web path causing a portion of said dye donor web to overhang said printing drum between said color discriminating optical sensors such that said sensors are at the overhang portion of said web.

2. In a thermal printer having a thermal printing head with a plurality of heating elements forming a thermal print line, a printing drum mounted near said printing head and spaced from said thermal print line, a receiver mounted on said printing drum, and a dye carrying donor web traversing a path between said printing head and said printing drum for printing contact with said receiver, the improvement comprising:

color discriminating optical sensors positioned alongside said thermal printing head near one end of said printing drum and directly in said donor web path at said thermal print line of said printing head to thereby detect different color patches on said donor web as said donor web advances, wherein a portion of said dye donor web overhangs said printing drum and passes between said color discriminating optical sensors such that said sensors are at the overhang portion of said web.

3. A thermal printer, comprising:

a thermal printing head having a plurality of heating elements forming a thermal print line;

a printing drum mounted near said printing head and spaced from said thermal print line a preselected distance;

a dye carrying donor web traversing a path between said printing head and said printing drum for printing contact with said receiver; and color discriminating optical sensors positioned alongside said thermal printing head near one end of said printing drum and directly in said donor web path to thereby detect different color patches on said donor web as said donor web advances, said dye donor web path causing a portion of said dye donor web to overhang said printing drum and pass between said color discriminating optical sensors, said color discriminating optical sensors being positioned at said thermal print line of said printing head such that said sensors are at the overhang portion of said web to thereby minimize waste of donor.

* * * * *